US006158920A

United States Patent [19]

Malot

[11] Patent Number: 6,158,920

[45] Date of Patent: Dec. 12, 2000

[54] ROADWAY STRUCTURE MADE FROM RIGID MATERIALS

[75] Inventor: Michel Malot, Bolbec, France

[73] Assignee: Total Raffinage Distribution S.A., Puteaux, France

[21] Appl. No.: 08/828,369

[22] Filed: Mar. 28, 1997

[30] Foreign Application Priority Data

Mar. 28, 1996 [FR] France ..... 96 03871

[51] Int. Cl.[7] ..... E01C 7/32

[52] U.S. Cl. ..... 404/27; 404/31; 404/82

[58] Field of Search ..... 404/17, 27, 28, 404/31, 71, 82

[56] References Cited

U.S. PATENT DOCUMENTS

| | | | |
|---|---|---|---|
| 2,062,615 | 12/1936 | Scripture, Jr. | 404/27 |
| 2,078,485 | 4/1937 | Dunham | 404/31 |
| 2,638,823 | 5/1953 | Roediger | 404/31 |
| 3,670,506 | 6/1972 | Gaudard | 61/35 |
| 4,151,025 | 4/1979 | Jacobs | 404/31 X |
| 4,371,401 | 2/1983 | Langumier . | |
| 4,708,516 | 11/1987 | Miller | 404/27 X |
| 4,834,577 | 5/1989 | Perfetti | 404/82 |
| 5,026,609 | 6/1991 | Jacob et al. | 404/31 X |
| 5,249,883 | 10/1993 | Watson et al. | 404/31 |
| 5,419,653 | 5/1995 | Hollon et al. | 404/17 |
| 5,445,473 | 8/1995 | Chaverot et al. | 404/75 |
| 5,513,925 | 5/1996 | Dempsey et al. | 404/17 |
| 5,759,250 | 6/1998 | Malot et al. | 106/281.1 |

FOREIGN PATENT DOCUMENTS

| | | | |
|---|---|---|---|
| 0-041 881 A | 12/1981 | European Pat. Off. . | |
| 0-433 155 | 6/1991 | European Pat. Off. . | |
| 609818 | 8/1994 | European Pat. Off. | 404/34 |
| 2 108 145 | 5/1972 | France . | |

OTHER PUBLICATIONS

Beer, Ferdinand P. and Johnston, Russell E., Jr., Mechanics of Materials, Appendix B., p. 585, 1981.

*Primary Examiner*—James A. Lisehora
*Attorney, Agent, or Firm*—Frommer Lawrence & Haug LLP; A. Thomas S. Safford; Thomas J. Kowalski

[57] ABSTRACT

A roadway structure comprising from top to bottom:

a top layer, at least one rigid foundation layer having a high modulus of rigidity and supporting the top layer, the ground, or an untreated material or a damaged roadway, and in addition particularly having an under layer beneath and adhered to the foundation layer, which under layer has a thickness such that it constitutes a support with a smooth and flat surface for the foundation layer laid thereon.

51 Claims, 1 Drawing Sheet

ROADWAY STRUCTURE MADE FROM RIGID MATERIALS

FIELD OF THE INVENTION

The present invention relates to a new roadway structure made from rigid materials.

BACKGROUND OF THE INVENTION

Roadways generally consist of several layers.

A top layer, which is in direct contact with road vehicles and which can be made from a conventional road asphalt, for example asphalt concrete (in the following, this layer shall be referred to as the "top layer").

At least one, and sometimes several, lower layers constituting the roadway foundation, and which can be made from materials treated with a hydraulic binder such as cement aggregate or slag aggregate or from a road asphalt (in the following, this layer shall be referred to as the "foundation layer" of the roadway).

In the process of building a roadway, these layers can be laid directly on the ground, or also on an untreated material (such as, for example, an untreated sand-gravel mixture or a reconstituted, moistened sand-gravel mixture).

In the process of strengthening a damaged roadway, the new layer or layers of treated materials are placed directly in contact with the top layer of the old roadway.

It is known that road specialists are often interested in using a foundation layer of great structural strength, namely one of high rigidity, which makes it possible to reduce layer thickness and, hence, roadway construction costs.

It is known that under the effect of tensile stresses caused by the road traffic, deformations and strains develop at the base of the layers, particularly at the base of the foundation layer. The repetition of these deformations and strains leads to mechanical fatigue which is responsible for cracking.

This well-known phenomenon occurs in several stages:

first, the deformation and tensile strains become localized at the base of the foundation layer, the maximum effect occurring at the bottom of the defects, then microcracks are formed appearing most typically at the bottom of the defects, and finally, when the strains exceed the tensile strength of the material, the microcracks are transformed into cracks propagating toward the top of the roadway and finally cause the roadway to rupture.

It is also known that cracking is even more pronounced in the case of a rigid foundation layer, namely one with a high modulus of rigidity.

In attempts to address these problems of road traffic-associated cracking, various measures of slowing down crack propagation have been proposed in the literature. All these measures aim at laying an intermediate layer between the top layer and the foundation layer. These measures include the following:

creating an interface consisting of a thin asphalt/rubber layer which is poured onto the foundation layer to separate the movements of the latter from those of the surmounting top layer;

enhancing the tensile strength of the surface layers of asphalt concrete with polyester mesh presenting adequate mechanical characteristics, said mesh being placed between the foundation layer and the top layer;

installing a nonwoven polyester material and covering said nonwoven material with an approximately 5 cm thick top layer of an asphalt concrete;

installing a nonwoven geotextile interface impregnated with an asphalt binder consisting of an asphalt modified with, for example, a copolymer of styrene and a conjugated diene such as butadiene, as described in French Patent Application FR-A-2 592 411 (or in equivalent U.S. Pat. No. 4,834,577, the content of this and of the other patent references cited herein being incorporated herein by reference);

installing a layer of a geotextile impregnated with a first asphalt binder bonded to a layer of aggregate coated with a second asphalt binder, as described in International Patent Application WO-94/01623 (or in equivalent U.S. Pat. No. 5,445,473).

All these different solutions recommend installing an interface between the top layer and the foundation layer for the purpose of retarding the upward crack propagation into the top layer.

These solutions can only be used for remedial purposes, because they are based on the assumption that the roadbed already presents cracks.

Moreover, these known techniques concern semirigid roadbeds, namely those with a foundation layer made from a material treated with a hydraulic binder such as cement aggregate or slag aggregate.

In practice, these techniques give more or less satisfactory results.

OBJECTIVES AND DESCRIPTION OF THE INVENTION

In pursuing research investigations in this field, applicant and his assignee have tried to treat the causes of cracking instead of treating the effects of cracking as proposed by the solutions of the prior art.

Applicant has thus found that when the modulus of rigidity of the foundation layer is high, the state of the surface of the base of the foundation layer, particularly the reduction of the "intaglio" defects thereof, has an effect on the formation of microcracks and, hence, on the roadway's resistance to mechanical fatigue which fatigue causes rupture problems.

This is why applicant has focused on rendering the surface of the base of the foundation layer as smooth and as flat as possible even when this layer is laid down on material whose surface is very irregular, such as an untreated material, or on a heavily damaged support, such as an existing roadway which is to be strengthened.

Thus, an object of the present invention is to provide a roadway comprising a rigid foundation layer with improved fatigue resistance, namely one that shows elevated resistance to high stresses exerted on the roadway by vehicles.

Surprisingly, applicant has found that by incorporating a special layer beneath the rigid foundation layer, it is possible to obtain a roadway of good quality with a long service life and which can be constructed even on a damaged support.

Hence, the present invention has as a first embodiment a roadway structure comprising from top to bottom:

a top layer, at least one rigid foundation layer with a high modulus of rigidity and supporting the top layer, the ground, or an untreated material, or a damaged roadway, supporting the foundation layer, said roadway structure being characterized in that it comprises, beneath the foundation layer whose modulus of rigidity is higher than or equal to $14\times10^3$ MPa, a layer adhering to said foundation layer and whose thickness is such that it constitutes a support of smooth and flat surface for the foundation layer.

In this definition of the invention, the modulus of rigidity is measured either by the AFNOR[1] norm NFP 98-260-2 (or by assignee's refinement: TOTAL method 762-94).

AFNOR=Association Francaise de Normalization=French Association for Standardization The present invention has as a second embodiment a process for fabricating said roadway structure, characterized in that, in successive stages, the ground or an untreated material or a severely degraded roadway is covered with a layer intended to adhere to the foundation layer and whose thickness is such that it constitutes a support of smooth and flat surface for said foundation layer, to this layer is applied the foundation layer having a modulus of rigidity greater than $14\times10^3$ MPa, the foundation layer is covered with the top layer.

BRIEF DESCRIPTION OF THE DRAWINGS

In this specification and in the accompanying drawing, some preferred embodiments of the invention are shown and described and various alternatives and modifications thereof have been suggested; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

Figure 1:
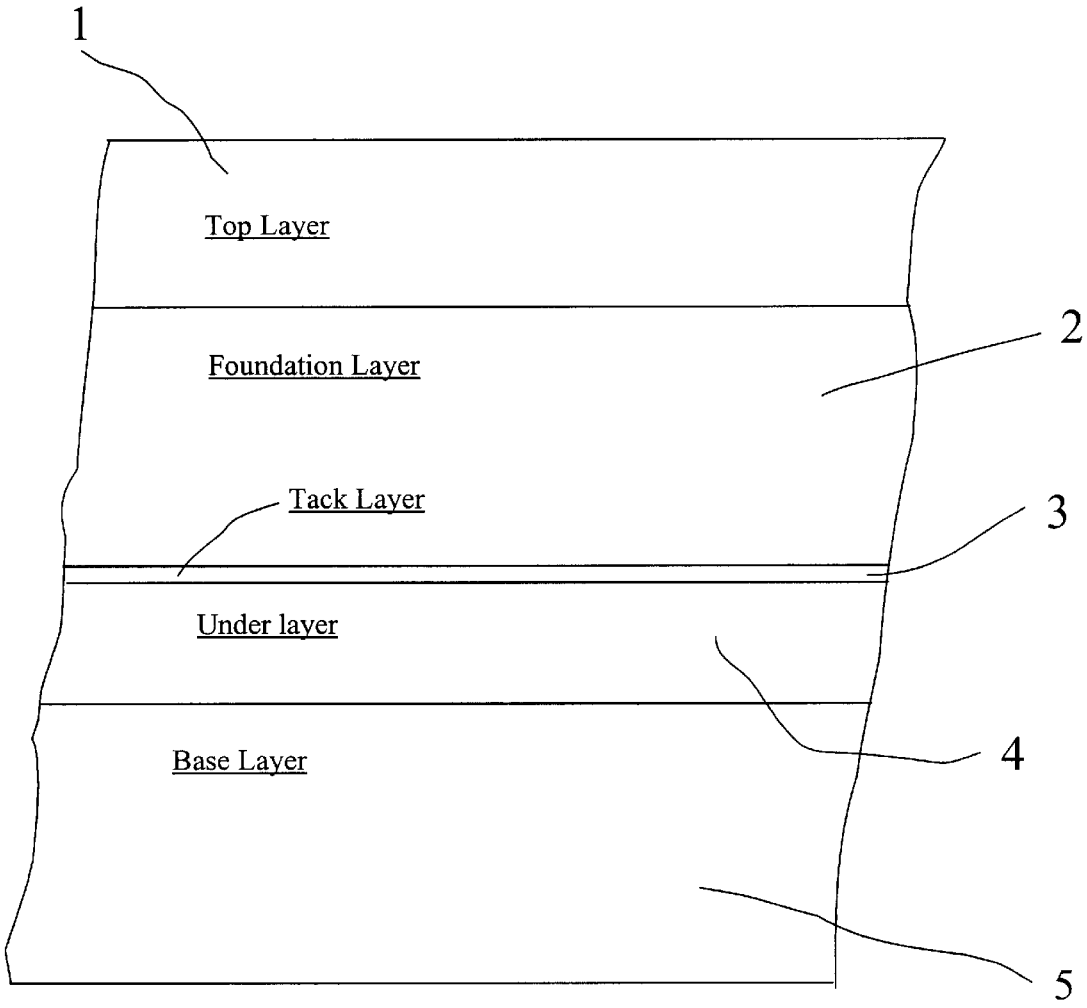
FIG. 1 is a schematic cross section showing the layers of a roadway constructed according to one preferred embodiment of the present invention.

According to the invention, the top layer 1 resting on the foundation layer 2 can advantageously be a conventional road asphalt such as, for example, an asphalt concrete.

The function of this top layer 1 is to ensure good protection of the structure and, by its roughness, good vehicle adherence.

The rigid foundation layer 2 with the structure according to the invention has a modulus of rigidity greater than or equal to $14\times10^3$ MPa at 15° C. and 10 Hz and can be based on, for example, a high-modulus asphalt material of the road asphalt type, or on a material treated with a hydraulic binder, such as cement aggregate or slag aggregate.

The function of this layer 2 is to provide a good foundation for the roadway.

Preferably used among these foundation layers 2 is one consisting of a road asphalt with a very high modulus of rigidity, developed by applicant's assignee, and which is the subject of French Patent Application No. 95 10097 (and of equivalent U.S. patent application Ser. No. 08/697,297, filed Aug. 26, 1996). Said road asphalt is made from a very hard binder with a penetrability at 25° C., measured by AFNOR method NFT 66-004, from 0 to 20 and which is contained in the road asphalt in an amount greater than 6 percent by weight.

As a result of its very rigid nature, indicated by a modulus of rigidity at 25° C. and 10 Hz higher than $24\times10^3$, said road asphalt imparts the same structural effect as do conventional materials, but does so in a much thinner layer of about 5 to 30 cm.

The under layer 4, disposed beneath the foundation layer 2, must fill the cavities and unevenness of the ground, of the untreated material or of the roadway to be strengthened, by which said under layer 4 is supported. Said under layer 4 therefore must be sufficiently thick to cover these irregularities thus forming for the foundation layer 2 a support of smooth and flat surface.

Moreover, said under layer 4 must adhere to the foundation layer 2 so that the final roadway will exhibit good mechanical properties, particularly in terms of mechanical fatigue.

Adhesion can be natural, if the under layer 4 is made from a sufficiently bituminous material.

In particular, said under layer 4 can be applied using an intermediate tack layer 3 made of a 70/100 asphalt.

The under layer 4 according to the invention, disposed beneath the foundation layer 2, can be made from different types of materials.

A first family of utilizable materials for forming the under layer 4 comprises road asphalts such as, for example, bituminous sand, surface-reshaping road asphalts such as, for example, road asphalts applied cold or asphalt concrete.

To impart to the under layer 4 according to the invention a smooth and flat surface, said materials, once applied, must have low macroroughness and high surface evenness.

Macroroughness is defined by a sand height of less than or equal to 4 mm and preferably less than or equal to 2 mm, measured by the sand height test according to NFP method 98-216-1.

The under layer 4 made from these road asphalts is applied according to NFP method 98-150 which confers to said layer 4 the desired surface evenness.

This under layer 4 can be made to adhere to the foundation layer 2 by means of an intermediate tack layer 3 of an emulsion of 70/100 asphalt applied at a rate of 300–400 g of residual binder/$m^2$.

A second family of utilizable materials for making the layer 4 to be placed beneath the foundation layer 2 comprises pourable asphalt materials such as, for example, cold-poured road asphalts, slurry seals or liquid asphalts.

To impart to the layer 4 according to the invention a flat and smooth surface, these materials must have a low macroroughness of the order of that of the aforesaid road asphalts.

The under layer 4 of these pourable asphalt materials is also applied according to NFP method 98-150, which confers to it the desired surface evenness.

Bonding to the foundation layer 2 is ensured by spreading out a tack layer 3 of, for example, an emulsion of 70/100 asphalt applied at a rate of 200 to 500 g of residual binder/$m^2$.

A third family of materials that can serve as the layer 4 to be placed beneath the foundation layer 2 comprises non-bituminous materials.

Examples of these are geotextiles, namely any textile sheets of tight fabric construction produced from natural or man-made yarns or fibers and which are conventionally used in road construction and ground stabilization operations.

The geotextile used according to the invention can be a nonwoven sheet having a weight per unit area from 50 to 500 g/$m^2$ and made of continuous filaments of a polymer such as a polyester, isotactic polypropylene, polyamide, polyacrylonitrile, cellulose acetate, polyvinyl chloride, polyvinylidene chloride or high-density polyethylene.

Particularly advantageous is a geotextile consisting of a nonwoven sheet of tight fabric construction made from continuous filaments of isotactic polypropylene or a polyester, particularly an alkylene glycol polyterephthalate or a polyamide, particularly a polycapramide or polyhexamethylene adipamide. In particular, the nonwoven sheet made from continuous filaments of a polymer can be the sheet described in any one of publications FR-A 1 601 049 (see equivalent U.S. Pat. No. 3,670,506), FR-A-2 108 145 (no English-language equivalent known to applicant), and FR-A-2 592 411 (see equivalent U.S. Pat. No. 4,834,577), said publications indicating the general method of producing such a sheet.

The geotextile can also be a nonwoven sheet having a weight per unit area from 50 to 500 g/m$^2$ and a mesh diameter of less than or equal to 5 mm, so as to impart smoothness.

Regardless of whether the geotextile is woven or nonwoven, it does not naturally adhere to the foundation layer 2 under which it is placed. Hence, said geotextile must be impregnated with an asphalt before it can be used as the layer 4 to be placed beneath the foundation layer 2.

The impregnation rate is from 200 to 800 g/m$^2$. This impregnation is achieved with hot asphalt or with an asphalt in the form of an emulsion, the asphalt present in the emulsion presenting a penetrability at 25° C. from 180 to 220 tenths of a millimeter.

Also suitable are, for example, geomembranes such as those consisting of polymeric films, slurries containing hydraulic binders, webbing of reject materials agglomerated by means of an organic or mineral binder, or layers treated with hydraulic binders.

To impart to the under layer 4 according to the invention a flat and smooth surface, these non-bituminous materials must have low macroroughness of the order of that of the aforesaid road asphalts.

The nonbituminous materials are also applied using an intermediate tack layer 3 of the cationic emulsion type which makes them adhere to the rigid foundation layer 2.

This tack layer 3, after being spread and after the emulsion has broken, consists of 200–500 g of residual binder/m$^2$.

Regardless of the nature of the material chosen to be placed under the foundation layer 2, its properties should enable it to resist well the mechanical and thermal conditions prevailing during the application of rigid road asphalts which, in particular, are typically used hot, at a temperature of about 170 to 200° C.

This material is equally well suited for the construction of new roadways and for the strengthening of existing ones.

In the construction of new roadways, the layer 4 to be placed beneath the foundation layer 2 can be laid directly on the ground 5 or on an untreated material 5, for example an untreated aggregate or a moistened reconstituted aggregate or other similar loose stony material.

To strengthen an already existing roadway 5, said layer 4 is applied directly to the old roadway 5 having a severely degraded surface.

Thus a new roadway according to the present invention has the following structure, from top to bottom:

one top layer 1 at least one foundation layer 2 the layer 4 adhering to the foundation layer and having a thickness such that it constitutes a smooth and flat support for said foundation layer 2:

the ground 5 or an untreated material 5.

A strengthened roadway presents the following structure, from top to bottom, a top layer 1, at least one foundation layer 2, the layer 4 adhering to the foundation layer 2 and having a thickness such that it constitutes a smooth and flat support for said foundation layer, the old roadway 5 to be strengthened.

These roadway structures according to the present invention not only have very much improved resistance to fatigue compared to the structures of the prior art; but, because they can be constructed by known conventional means, they also have the advantage of not requiring complicated or costly application methods.

The following examples illustrate the invention without limiting its scope.

EXAMPLE 1

This example concerns a material of the road asphalt type recommended by applicant for use, in the construction of a roadway, as the layer 4 to be placed beneath the rigid foundation layer 2 of the roadway.

Said material is a bituminous sand used in the form of a road asphalt applied hot and made from an asphalt acting as binder and having a penetrability at 25° C. between 35 and 50 tenths of a millimeter.

The penetrability is measured by AFNOR method NFT 66-004.

The macroroughness of this bituminous sand is defined by a sand height of about 3 mm, according to NFP method 98-216-1.

This bituminous sand has a modulus of rigidity from 2.8 to 3.0, an asphalt content of 5.2 wt % and a particle size between 0 and 6 or between 0 and 10 mm, as shown in the following:

| Passing Through, % | Diameter of Mesh Opening, mm |
|---|---|
| 15 | 0.08 |
| 64 | 0.2 |
| 77 | 0.717 |
| 91 | 0.5 |
| 97 | 1 |
| 100 | 2 |

This layer 4 of bituminous sand is applied according to NFP method 98-150 which confers to it high surface evenness. Said layer 4, after cooling and application of a tack layer 3 of the asphalt emulsion type applied at a rate of 250–300 g of residual binder/m$^2$, has a final thickness of 2 cm.

EXAMPLE 2

This example concerns a material of the road asphalt type recommended by applicant for use, in the strengthening of a roadway, as the layer to be placed beneath the rigid foundation layer 2 of the new roadway 5 and on the roadway to be strengthened.

This material is a surface-reshaping road asphalt, namely a road asphalt applied hot and prepared from an asphalt having a penetrability at 25° C. between 35 and 50 tenths of a millimeter.

This road asphalt has a sandy character and a particle size from 0 to 6 mm or from 0 to 10 mm, as shown in the following.

| Passing Through, % | | Diameter of Mesh Opening, |
|---|---|---|
| 0/6 | 0/10 | mm |
| 12 | 10 | 0.08 |
| 60 | 50 | 2.0 |
| 100 | 80 | 6.3 |

This road asphalt has a modulus of rigidity k greater than or equal to 3.0 if the particle size of said road asphalt is between 0 and 6 mm, and greater than or equal to 2.8 if the particle size of the road asphalt is between 0 and 10 mm.

This road asphalt also has a macroroughness, defined by the sand height according to NFP method 98-216-1, of about 3.5 mm.

This road asphalt is applied according to NFP method 98-150 which confers to it high surface evenness, a tack layer 3 of the asphalt emulsion type being applied at 250–300 g of residual binder/$m^2$.

EXAMPLE 3

This example concerns a material of the pourable bituminous type recommended by applicant for use, in the construction of a new roadway, as the layer 4 to be placed beneath the rigid foundation layer 2 of the roadway.

This material is a road asphalt poured cold and having an asphalt content from 5 to 8 wt % and a particle size from 0 to 4 mm or from 0 to 10 mm.

This road asphalt has a macroroughness, defined by a sand height of about 4 mm, according to NFP method 98-216-1.

This layer 4 is applied according to NFP method 98-150 which confers to it high surface evenness. The tack layer 3 is of the cationic emulsion type prepared from an asphalt having a penetrability from 70 to 100 tenths of a millimeter and applied at a rate of 200–500 g of residual binder/$m^2$.

EXAMPLE 4

This example concerns a material of the geotextile type recommended by applicant for use in the construction of a new roadway, as the layer 4 to be placed beneath the rigid foundation layer 2 of said new roadway.

Said geotextile is based on polyester fibers and glass webbing having a total weight of 135 g/$m^2$ the rate of asphalt impregnation being 460 g/$m^2$.

The polyester fibers weigh 80 g/$m^2$; their mechanical resistance is 2 kN/m and their elongation 40%.

The glass webbing weighs 55 g/$m^2$; its mechanical resistance is 14 kN/m and its elongation 3%.

The rate of impregnation of this geotextile is 600 g/$m^2$. It is impregnated with an emulsion of an asphalt having a penetrability from 180 to 220 tenths of a millimeter.

What is claimed is:

1. Roadway structure comprising:

a top layer;

at least one asphaltic rigid foundation layer with a high modulus of rigidity greater than or equal to $14\times10^3$ MPa which supports the top layer;

a base supporting the foundation layer chosen from the group consisting of earth, a layer of untreated loose stony material bedded on the earth, and a damaged roadway; and an under layer formed on said base and beneath and adherent to said foundation layer and having a thickness effective to give a surface for the foundation layer supported thereon, wherein the under layer has low macroroughness, defined by a sand height of less than or equal to 4 mm according to NFP method 98-216-1, and a high surface evenness sufficiently smooth and flat so as to increase service life by reducing cracking due to mechanical fatigue that would occur in the absence of such an under layer.

2. Roadway structure according to claim 1, wherein said under layer is made from a road asphalt.

3. Roadway structure according to claim 1, wherein said under layer is chosen from the group consisting of bituminous sand, surface-reshaping road asphalt, road asphalt applied cold, and asphalt concrete.

4. Roadway structure according to claim 3, wherein said under layer comprises bituminous sand.

5. Roadway structure according to claim 3, wherein said under layer comprises surface-reshaping road asphalt.

6. Roadway structure according to claim 3, wherein said under layer comprises road asphalt applied cold.

7. Roadway structure according to claim 3, wherein said under layer comprises asphalt concrete.

8. Roadway structure according to claim 1, wherein said under layer is made from a pourable bituminous material.

9. Roadway structure according to claim 1, wherein said under layer is chosen from the group consisting of a road asphalt poured cold, a slurry seal, and a poured asphalt.

10. Roadway structure according to claim 9, wherein said under layer comprises road asphalt poured cold.

11. Roadway structure according to claim 9, wherein said under layer comprises a slurry seal.

12. Roadway structure according to claim 9, wherein said under layer comprises a poured asphalt.

13. Roadway structure according to claim 1, wherein said under layer is made from a non-bituminous material, chosen from the group consisting of geotextiles, geomembranes inclusive of polymeric films, slurries with hydraulic binders, webbing of reject materials agglomerated by means of an organic or mineral binder, and layers treated with hydraulic binders.

14. Roadway structure according to claim 13, wherein said under layer comprises geotextiles.

15. Roadway structure according to claim 13, wherein said under layer comprises geomembranes inclusive of polymeric films.

16. Roadway structure according to claim 13, wherein said under layer comprises slurries with hydraulic binders.

17. Roadway structure according to claim 13, wherein said under layer comprises webbing of reject material agglomerated by means of an organic or mineral binder.

18. Roadway structure according to claim 13, wherein said under layer comprises layers treated with hydraulic binders.

19. Roadway structure according to claim 1, wherein said under layer is chosen from the group consisting of road asphalt, bituminous sand, asphalt concrete, pourable bituminous material, slurry seal, poured asphalt, geotextiles, geomembranes inclusive of polymeric films, slurries with hydraulic binders, webbing of reject materials agglomerated by means of an organic or mineral binder, layers treated with hydraulic binders, and combinations thereof.

20. Roadway structure according to claim 19, wherein said under layer has a macroroughness, defined by a sand height of less than 2 mm, according to NFP method 98-216-1.

21. Roadway structure according to claim 20, wherein said under layer includes a tack layer comprising an asphalt emulsion.

22. Roadway structure according to claim 21, wherein said top layer is an asphalt concrete.

23. Roadway structure according to claim 22, wherein said foundation layer is a road asphalt made from a binder having a penetrability at 25° C. from 0 to 20.

24. Roadway structure according to claim 23, wherein said foundation layer consists of a road asphalt made from a binder present in the road asphalt in an amount exceeding 6 wt %.

25. Roadway structure according to claim 24, wherein said foundation layer has a thickness from 5 to 30 cm.

26. Roadway structure according to claim 1, wherein said foundation layer is a road asphalt made from a binder having a penetrability at 25° C. from 0 to 20.

27. Roadway structure according to claim 20, wherein said top layer is an asphalt concrete.

28. Roadway structure according to claim 27, wherein said foundation layer has a thickness from 5 to 30 cm.

29. Roadway structure according to claim 19, wherein said foundation layer is a road asphalt made from a binder having a penetrability at 25° C. from 0 to 20.

30. Roadway structure according to claim 19, wherein said under layer comprises road asphalt.

31. Roadway structure according to claim 1, wherein said under layer has a macroroughness, defined by a sand height of less than 2 mm, according to NFP method 98-216-1.

32. Roadway structure according to claim 1, wherein said under layer includes a tack layer comprising an asphalt emulsion.

33. Roadway structure according to claim 1, wherein said top layer is an asphalt concrete.

34. Roadway structure according to claim 33, wherein said foundation layer is a road asphalt made from a binder having a penetrability at 25° C. from 0 to 20.

35. Roadway structure according to claim 34, wherein said foundation layer consists of a road asphalt made from a binder present in the road asphalt in an amount exceeding 6 wt %.

36. Process for fabricating a roadway structure comprising the following successive steps:

covering earth or untreated material on earth or degraded roadway on earth with an under layer effective to adhere to an asphaltic rigid foundation layer having a modulus of rigidity of $14\times10^3$ MPa or greater, wherein the foundation layer is to be superimposed on the under layer, with the thickness of the under layer being such that it constitutes a support giving a surface for said foundation layer; wherein the under layer has a low macroroughness, defined by a sand height of less than or equal to 4 mm according to NFP method 98-216-1, and a high surface evenness sufficiently smooth and flat so as to increase service life by reducing the cracking due to mechanical fatigue that would occur in the absence of such an under layer, applying the roadway foundation layer onto the smooth, flat supporting surface of the under layer, and covering the foundation layer with a roadway top layer.

37. Process according to claim 36, wherein said top layer is formed from an asphalt concrete; and wherein said under layer is laid to a macroroughness, defined by a sand height, of less than 2 mm, according to NFP method 98-216-1.

38. Process according to claim 37, wherein said foundation layer is formed to a thickness from 5 to 30 cm; and wherein said under layer is made from a material chosen from the group consisting of road asphalt, bituminous sand, asphalt concrete, pourable bituminous material, slurry seal, poured asphalt, geotextiles, geomembranes inclusive of polymeric films, slurries with hydraulic binders, webbing of reject materials agglomerated by means of an organic or mineral binder, layers treated with hydraulic binders, and combinations thereof.

39. Process according to claim 36, wherein said under layer comprises bituminous sand.

40. Process according to claim 36, wherein said under layer comprises surface-reshaping road asphalt.

41. Process according to claim 36, wherein said under layer comprises road asphalt applied cold.

42. Process according to claim 36, wherein said under layer comprises asphalt concrete.

43. Process according to claim 36, wherein said under layer comprises road asphalt poured cold.

44. Process according to claim 36, wherein said under layer comprises a slurry seal.

45. Process according to claim 36, wherein said under layer comprises a poured asphalt.

46. Process according to claim 36, wherein said under layer comprises geotextiles.

47. Process according to claim 36, wherein said under layer comprises geomembranes inclusive of polymeric films.

48. Process according to claim 36, wherein said under layer comprises slurries with hydraulic binders.

49. Process according to claim 36, wherein said under layer comprises webbing of reject material agglomerated by means of an organic or mineral binder.

50. Process according to claim 36, wherein said under layer comprises layers treated with hydraulic binders.

51. Process according to claim 36, wherein said under layer comprises road asphalt.

* * * * *